US006705197B1

(12) United States Patent
Neal

(10) Patent No.: US 6,705,197 B1
(45) Date of Patent: Mar. 16, 2004

(54) LIGHTWEIGHT FABRIC BASED BODY ARMOR

(76) Inventor: Murray L. Neal, 681 E. Brighton La., Fresno, CA (US) 93720

( * ) Notice: Subject to any disclaimer, the term of this patent is extended or adjusted under 35 U.S.C. 154(b) by 195 days.

(21) Appl. No.: 09/847,630

(22) Filed: May 2, 2001

(51) Int. Cl.[7] ..... F41H 5/08
(52) U.S. Cl. ..... 89/36.05; 89/36.02; 2/2.5
(58) Field of Search ..... 89/36.05, 36.02; 2/2.5

(56) References Cited

U.S. PATENT DOCUMENTS

| | | | | | |
|---|---|---|---|---|---|
| 4,287,607 | A | * | 9/1981 | Leach | 2/2.5 |
| 5,343,796 | A | * | 9/1994 | Cordova et al. | 89/36.02 |
| 5,724,670 | A | * | 3/1998 | Price | 2/2.5 |
| 5,796,028 | A | * | 8/1998 | Field et al. | 89/36.05 |
| 5,996,115 | A | * | 12/1999 | Mazelsky | 2/2.5 |
| 6,266,819 | B1 | * | 7/2001 | Bachner, Jr. | 89/36.02 |

FOREIGN PATENT DOCUMENTS

| | | | | |
|---|---|---|---|---|
| EP | 572 965 | A1 * | 12/1993 | 89/36.05 |
| EP | 585 793 | A1 * | 3/1994 | 89/36.05 |

OTHER PUBLICATIONS

Point Blank Body Armor; Jan. 1992; 5 pages +pp. 1–62.*

* cited by examiner

*Primary Examiner*—Stephen M. Johnson
(74) *Attorney, Agent, or Firm*—Blakely, Sokoloff, Taylor & Zafman LLP

(57) ABSTRACT

A soft fabric multithreat ballistic vest is disclosed. The vest is a combination of different types of ballistic fabric used together, One type of ballistic fabric serves to slow and deform a projectile through plastic deformation and heat transfer. The other material serves to slow a projectile and absorb its energy thereby reducing backface deformation. The combination of various types of ballistic grade material allow the use of fewer total plies of material and a lighter weight end product than if either one type of material was used alone.

25 Claims, 2 Drawing Sheets

LIGHTWEIGHT FABRIC BASED BODY ARMOR

FIELD OF THE INVENTION

1. Field of the Invention

The invention relates to fabric based body armor. More specifically, the invention relates to fabric based body armor capable of defeating multiple threats.

2. Background

In recent years, ballistic resistant materials formed from high tensile strength fibers such as aramid fabrics or polyethene fabrics have gone into common use. These fabrics have been used to form flexible fabric-based bullet defeating vests. These ballistic resistant materials typically have the advantages of greater tensile strength and less weight per unit area than metals.

High tensile strength fibers such as, for example, aramid fibers and polyethylene fibers in fabrics have been placed into vests to protect the torso of individuals. Typically, multiple layers of high tensile strength aramid or polyethene fabric are used in a single vest. Multiple layers of these materials are required because a single layer is insufficient to stop a ballistic projectile. Attaching sufficient plys of fabric to the vest necessary to defeat a ballistic projectile still leaves the vest lighter than it would be, and more flexible than had it been made out of metal.

Typically, soft fabric vests are adequate to defeat ballistic pistol rounds. One method of measuring the ability of a soft fabric vest to defeat these rounds has been established by the National Institute of Justice (NIJ). The highest level of protection standard the National Institute of Justice has issued for pistol rounds is the Level III-A Threat. The Level III-A threat is designed to simulate high velocity pistol rounds traveling at least 1,400 feet per second when they impact the target vest. The NIJ III-A Level Threat is part of the National Institute of Justice Standard 0101.04. Another part of the NIJ Standard 0101.04 is a standard for backface deformation allowed by the vest. As part of this backface deformation standard a vest, even when it stopped a ballistic projectile completely, is allowed to deform towards the body no more than 44 millimeters (mm), or 1.73 inches(in) as measured into a standard clay material.

The damage done by explosive device fragmentation can be modeled using a bullet type sabot fragment simulator. One such simulator is a right round circular penetrator. These penetrators are solid steel projectiles with blunt ends about 0.217 inches in diameter and 0.220 inches in length. Another simulator for fragmentation protection is defined by Military Standard (Mil Std) 662E. Military Standard 662E provides inter alia for a 16 grain chisel point, right round circular penetrator that impacts the vest at a velocity of at least 650 meters per second (mps) (2132 feet per second).

The principle threats faced by personnel in a military environment are ballistic projectiles and fragment/shrapnel. A military pistol ballistic projectiles is typified by a military 9 mm ball round. Fragmentation/shrapnel projectiles are typically generated by the destruction of an explosive round's casing. The explosive round can be either artillery, mortar or grenade.

Soft fabric ballistic defeating armor vests are typically not recommended for use against fragmentation. This is because fragments, unlike bullets, do not deform as easily as bullets and are able to penetrate the multiple layers of fabric in the vest with greater ease.

DETAILED DESCRIPTION OF THE INVENTION

Figure 1A:
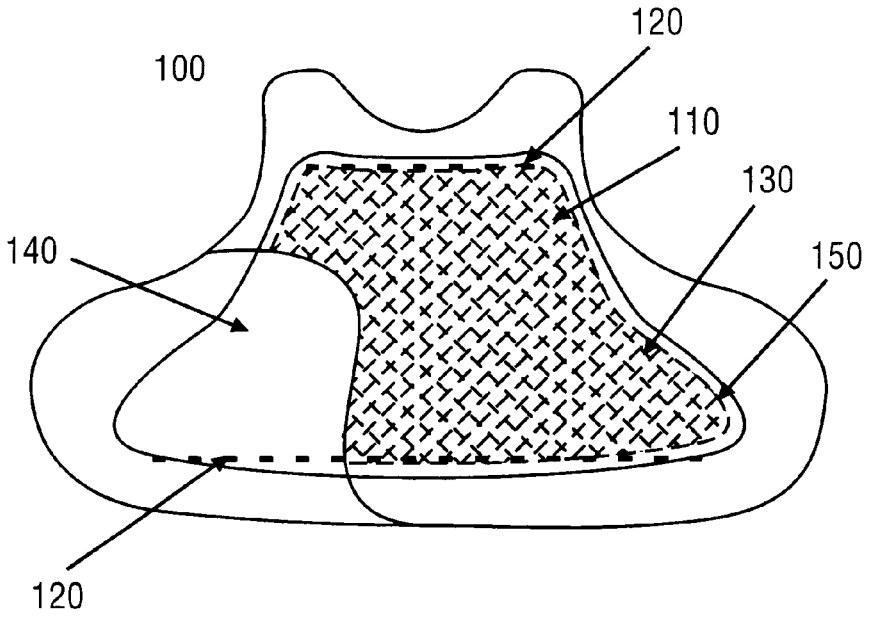
FIG. 1A is a cut-away plain view of one embodiment of the drawing of the body armor.

One of the methods in which a soft fabric ballistic armor body vest will defeat a ballistic projectile is by deforming the projectile and spreading out the area of impact being met by the vest. High tensile strength aramid and polyethene fabrics are useful in this situation because of their tremendous ability to both deform the projectile on impact, and bring the projectile to a stop. The fibers in high tensile strength ballistic fabrics also have a high elongation of yield allowing them to hang on to a projectile as the fibers in the fabric stretch before failure. These greater periods of hanging on to the projectile while stretching before failure allow the threads of the fabric to cause greater deformation to the projectile's surface.

Aramid fabrics with high tensile strengths have high resistance to penetration by ballistic projectiles. This resistance to penetration comes from a combination of the aramid fabric's, fiber tensile strength, elongation of yield, selected pick count, and high heat resistance.

A ballistic fabric's thread stops a projectile by remaining in its path until failure. The thread, as it is impacted by the projectile, is plastically deformed until the thread is broken. The energy required to break the thread is absorbed from the projectile, thus reducing the energy of the projectile and its velocity. Threads with a high tensile strength require more energy to break than threads with low tensile strengths.

The high tensile strength fibers in an aramid fabric with a high elongation of yield have an ability to deform and slow down a ballistic projectile. A ballistic fiber with a higher elongation to failure will tend to hang on to the projectile as the fibers of the material stretch. The stretching of the material allows additional time for the fabric to hang on to the projectile deforming the projectile and slowing it down as fibers elongate, before yielding to penetration. Deforming the ballistic projectile causes the front end of the projectile to expand radially normal to the direction of its flight in a manner that can be described as mushrooming. This action is described as mushrooming because the stopped bullet, when removed from the vest, tends to look like a mushroom. Causing the leading surface of a projectile to expand is advantageous, because an expanded leading edge has greater surface area in contact with the vest material. A ballistic resistant vest material is better able to stop a projectile with a larger surface area in contact with the vest, because that allows more threads of the fabric to engage the projectile adding their tensile strength to the stopping power of the fabric.

Pick count is a measure of the number of threads of fiber in a given area of fabric. The greater the pick count the greater the number of threads in a given area the fabric has. Each thread in the shadow of the projectile's impact absorbs energy from the projectile when it yields. Thus a fabric with a high pick count may have a greater resistance to penetration than a fabric with an identical thread but a lower pick count.

In adjusting the denier and pick count of a fabric, care must be given to not place too may fibers with too high a denier in a given area. As denier increases, the diameter of the fiber increases. Increasing the denier of a fiber without reducing the pick count of the fabric may lead to crimping. Crimping occurs when the fibers are so tightly packed together at crossover points the fibers cannot elongate. When crimping occurs there is no benefit gained from the fiber's ability to stretch. Thus, too high a denier combined with too high a pick count results in crimping and reduced efficiency of the fabric.

Aramid fabrics have a high resistance to heat. Ballistic events, where a projectile is deformed and stopped, generate a significant amount of heat. Aramid fabrics retain their structural integrity in high temperature episodes better than other fabrics. This high resistance to heat allows aramid fabrics to retain their high tensile strength and elongation of yield during ballistic events. In addition, the heat generated at impact helps to soften the projectile and adds to the deformation of the projectile caused by impact with the fabric.

Polyethylene fabric is made by combining fibers and sheets of polyethylene. The fibers are coated in a resin and a unidirectional layer of fibers is cross laid with another unidirectional layer of fibers at 90° to each other. The fibers are then sandwiched between two polyethylene sheets to form a fabric. The polyethylene fabric has an enhanced ability over aramid fabric to absorb the energy of a projectile, and by absorbing this energy, reduces the back-face deformation generated by a stopped projectile. Back-face deformation is a measure of how far into the vest wearer's body, even though the vest does not completely fail, the projectile penetrates before it is stopped. In order to meet National Institute of Justice Standard 0101.04, for backface deformation, the deformation can be no greater than 44 mm, or 1.73 inches into a standard clay modeling material.

Combining a layer of multiple plies of aramid material over a layer of multiple plies of polyethylene material enables a combination of the two materials's strengths to be used in concert in a single vest. Aramid fabrics have a greater resistance to heat generated through plastic deformation in stopping a ballistic projectile than polyethylene fabric. Thus it is beneficial to have a projectile strike an aramid fabric, where the projectile is deformed and its energy is reduced, before it strikes a polyethylene fabric. As mentioned above, the aramid material is resistant to penetration and induces deformation into the projectile, causing the projectile to present a greater surface area to the vest. The polyethylene fabric, on the other hand, once the projectile's leading edge has been expanded by the aramid fabric can absorb the energy of the projectile in a manner to limit damage by trauma to the body wearing the vest. This combination of aramid and polyethylene fabric can stop a given level of threat using fewer plies of material than a vest made of either fabric.

It should be noted that similar fabric materials with different deniers and pick counts effectively make different material. This is because they will have different mechanical properties. Higher denier means there is more of the fiber per length of thread. This additional material gives the thread greater tensile strength. Greater tensile strength gives the fabric greater resistance to penetration. Higher pick counts mean there are more threads per area to be struck by the projectile. These additional threads in higher pick count materials add their tensile strength to the resistance to penetration of the fabric. Due to the above mentioned relation between fiber denier and pick count, a higher denier fiber with a lower pick count may still have the same strength, but increasing the denier of the thread to increase tensile strength will cause the weight of fabric to increase.

While materials with similar deniers and pick counts might be thought to have similar stopping power and ballistic abilities, a varying elongation of failure can make these materials respond to ballistic events differently. Thus it is not always possible to base exact ratios of projectile stopping ability based on only denier and pick counts.

One embodiment of the invention employs lay ups of Kevlar™ KM2 600 denier fabrics, and Dyneema™ SB31 fabrics. One of ordinary skill in the art would recognize however that with adequate notice given to denier, pick count and elongation of failure, various materials might be substituted for the materials mentioned above. Such substitutions can be, but are not limited to, para aramids such as PBO, Zylon™, various denier Kevlar™ KM2 materials such as 500 or 400 denier material, Kevlar™ 129 500 and 400 denier material, Spectra™ polyethylene fabrics, and Dyneema™ polyethylene fabrics.

Reference will now be made to drawings. In the following drawings, like structures are provided with like reference designations. In order to show the structure of the invention more clearly, the drawings included herein are diagrammatic representations of the indicated structures. Thus, the actual appearance of the fabricated structures, for example, in a photograph, may appear different while still incorporating the essential structures of the invention. Moreover, the drawings show only the structures necessary to understand the invention. Additional structures known in the art have not been included to maintain the clarity of the drawings.

FIG. 1A is a cut-away planer view of one embodiment of the invention. The multi-threat vest 100 comprises two layers of different ballistic resistant fabrics, one behind the other. The first layer 130 in one embodiment can be fourteen plies of aramid fabric such as Kevlar™ KM2 600 denier aramid material with a pick count of about 34×34. These fourteen plies of aramid fabric would typically have an areal density of about 8.24 ounce per square foot. The first layer of aramid fabrics is coupled to itself by a 1 inch diamond stitch quilt 110 across the field of the layer. The quilt also has a border stitch 150 around the perimeter of the protected area. The second layer of the multithreat vest 140 in one embodiment can be twenty plys of Dyneema™ SB 31. These twenty plys of Dyneema™ SB 31 fabric typically have an areal density of about 8.4 ounce per square foot. The plys of Dyneema™ are best coupled together with a simple bar tack 120 at the top and bottom of the panel.

Figure 1B:
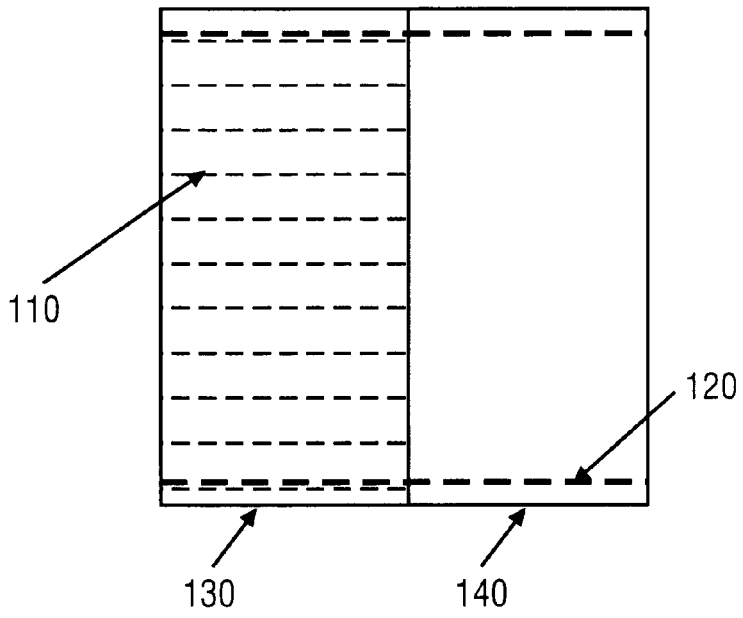
FIG. 1B is a cut-away side view of one embodiment of the drawing of the body armor.

FIG. 1B is a cut-away side view of one embodiment of the multithreat vest. The figure shows first layer 130 which in one embodiment can comprise fourteen plies of aramid fabric such as Kevlar™ KM2 The second layer 140 in one embodiment comprise twenty plies of Dyneema SB 31 Polyethylene fabric. In the cut-away view, the 1 inch diamond stitch 110 can be seen in first layer 130 of aramid fabric. The diamond stitch does not penetrate into the second layer 140 as seen in FIG. 1B. The bar tack 120 holds the first and second layer together as noticed above.

Figure 2:
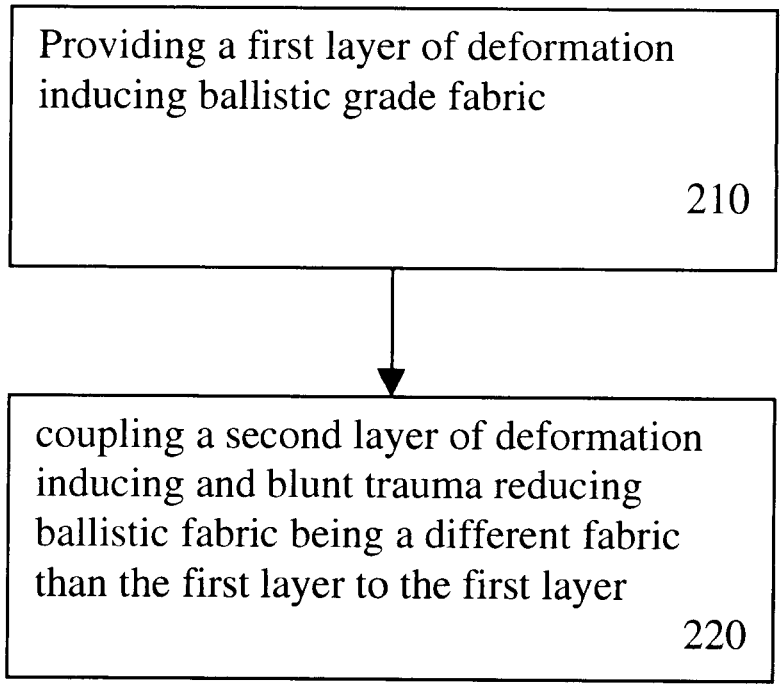
FIG. 2 is a flow chart showing one method of fabricating the soft fabric body armor.

FIG. 2 is a flow diagram representing one method of fabricating the soft fabric-based body armor of FIG. 1. In one embodiment of FIG. 2, the first layer of deformation inducing ballistic grade fabric is provided in block 210. This first layer of deformation inducing ballistic grade fabric has coupled to it a second layer of ballistic grade fabric that induces deformation and reduces blunt trauma caused by a ballistic projectile as shown in block 220. Once attached as, described, the layers are bar tacked together.

As described above, one measure of ballistic stopping ability is Military Standard 662E. The standard requires a vest capable of meeting Military Standard 662E to defeat a 16 grain fragment simulating round having a velocity of at least 650 mps (2132 ft./sec.). The soft body armor vest of one embodiment of the invention exceeds the requirement of the 16 grain Mil Std 662E fragment simulator.

The NIJ standard for ballistic projectile protection 0101.04 is also described above. The soft body armor of one embodiment of the invention exceeds the requirements of the NIJ 0101.04 standard for a level III-A threat including projectile velocity and backside deformation.

In the preceding detailed description, the invention is described with reference to specific embodiments thereof. It will, however, be evident that various modifications and changes may be made thereto without departing from the broader spirit and scope of the invention as set forth in the claims. The specification and drawings are; accordingly, to be regarded in an illustrative rather than a restrictive sense.

What is claimed is:

1. A multi threat vest comprising:

a first layer having a plurality of plies of a ballistic grade fabric coupled together;

a second layer having a plurality of plies of a ballistic grade fabric coupled together, being a different fabric than the first layer;

wherein the vest has an areal density of less than 1.3 pounds per square foot of protected area, and defeats National Institute of Justice level III-A threats and a right round 16 grain circular penetrator fragmentation simulator projectile with a velocity of at least 2130 feet per second.

2. The vest of claim 1, wherein the first layer tends to deform and stop a ballistic projectile.

3. The vest of claim 2, wherein the first layer comprises an aramid fabric.

4. The vest of claim 3, wherein the first layer comprises less than 25 plies of an aramid fabric having a denier of less than about 700, a pick count of less than 40×40 and an areal density per ply of no more than about 0.59 oz. per sq. ft.

5. The vest of claim 1, wherein the plys of the first layer are coupled together with a one inch diamond field stitch and a perimeter stitch.

6. The vest of claim 1, wherein the second layer tends to deform a ballistic projectile, and reduce blunt trauma.

7. The vest of claim 6, wherein the second layer comprises a polyethylene fabric.

8. The vest of claim 7, wherein the second layer comprises less than 25 plys of a polyethylene fabric having an areal density per ply of no more than about 0.42 oz. per sq. ft.

9. The vest of claim 1, wherein the first layer is coupled together by a bar tack at a top and bottom of the fabric.

10. The multi threat vest of claim 1, wherein the total ply count of all the layers is less than 50.

11. A multi threat vest comprising:

a first layer of ballistic grade fabric;

a second layer of ballistic grade fabric, coupled to and backing the first layer, being different than the first layer;

wherein the different layers of ballistic fabric have at least an equal stopping power using fewer plies of material for being arranged as described than a greater number of plies of either fabric alone, and the vest has an areal density of less than 1.30 pounds per square foot of protected area, and defeats National Institute of Justice level III-A threats and a right round 16 grain circular penetrator fragmentation simulator projectile with a velocity of at least 2130 feet per second.

12. The multi threat vest of claim 11, wherein a plurality of plies of a first fabric coupled together is used for the first layer, and a plurality of plies of a second fabric coupled together is used for the second layer.

13. The multi threat vest of claim 12, wherein the first fabric has a denier of less than approximately 700, a pick count of less than approximately 40×40 and an areal density per ply of less than about 0.59 oz. per sq. ft.

14. The multi threat vest of claim 12, wherein the first fabric tends to induce deformation into a ballistic projectile impacting it.

15. The multi-threat vest of claim 12, wherein the plurality of plys of the first fabric are coupled together with a diamond field stitch and a perimeter stitch.

16. The multi threat vest of claim 12, wherein the first layer has a ply count of less than 25.

17. The multi threat vest of claim 12, wherein the second fabric has an areal density per ply of no more than about 0.42 oz. per sq. ft.

18. The multi threat vest of claim 12, wherein the second fabric tends to deform a ballistic projectile, and reduce blunt trauma.

19. The multi-threat vest of claim 12, wherein the plurality of plys of the second fabric are coupled together by a bar tack of a top and bottom of the fabric.

20. The multi threat vest of claim 12, wherein the second layer has a ply count of less than 25.

21. The multi threat vest of claim 12, wherein the total ply count of all the layers is less than 50.

22. A method of making a multi threat vest comprising:

providing a first layer of a plurality of plies of a deformation inducing ballistic grade fabric coupled together;

coupling a second layer of a plurality of plies of deformation inducing and blunt trauma reducing ballistic fabric, being a different fabric than the first layer, to the first layer, wherein the multi threat vest has an -areal density of less than 1.30 pounds per square foot of protected area, and defeats National Institute of Justice level III-A threats and a right round 16 grain circular penetrator tragmentation simulator projectile with a velocity of at least 2130 feet per second.

23. The method of claim 22, further comprising:

coupling the plys of the first layer together by stitching a one inch diamond field stitch and a perimeter stitch.

24. The method of claim 22, further comprising:

coupling the plys of the second layer together by bar tacking them at the top and bottom.

25. The method of claim 22, further comprising:

coupling the first and second layer together by bar tacking them at the top and bottom.

* * * * *